US010443830B2

(12) United States Patent
Weston et al.

(10) Patent No.: US 10,443,830 B2
(45) Date of Patent: Oct. 15, 2019

(54) LIGHT SOCKET ADAPTER

(71) Applicants: Stewart I. Weston, Coto De Caza, CA (US); Fortino Reyes, Santa Ana, CA (US)

(72) Inventors: Stewart I. Weston, Coto De Caza, CA (US); Fortino Reyes, Santa Ana, CA (US)

( * ) Notice: Subject to any disclaimer, the term of this patent is extended or adjusted under 35 U.S.C. 154(b) by 56 days.

(21) Appl. No.: 15/360,775

(22) Filed: Nov. 23, 2016

(65) Prior Publication Data

US 2017/0191645 A1 Jul. 6, 2017

Related U.S. Application Data

(60) Provisional application No. 62/259,999, filed on Nov. 25, 2015.

(51) Int. Cl.

| | |
|---|---|
| ***F21V 23/06*** | (2006.01) |
| ***F21S 8/04*** | (2006.01) |
| ***F21V 21/002*** | (2006.01) |
| ***H01R 33/94*** | (2006.01) |
| *F21Y 115/10* | (2016.01) |
| *F21W 121/00* | (2006.01) |
| *F21V 21/14* | (2006.01) |

(52) U.S. Cl.

CPC ..... *F21V 23/06* (2013.01); *F21S 8/043* (2013.01); *F21V 21/002* (2013.01); *H01R 33/94* (2013.01); *F21V 21/14* (2013.01); *F21W 2121/00* (2013.01); *F21Y 2115/10* (2016.08)

(58) Field of Classification Search

CPC ..... F21V 21/14; F21V 23/06; F21V 21/04; H01R 33/94

See application file for complete search history.

(56) References Cited

U.S. PATENT DOCUMENTS

| | | | | | |
|---|---|---|---|---|---|
| 4,039,822 | A * | 8/1977 | Chan | F21S 8/02 | 362/183 |
| 5,833,357 | A * | 11/1998 | Ting | F21L 14/02 | 362/376 |
| 6,036,522 | A * | 3/2000 | Holzer | F21V 19/0005 | 439/306 |
| 7,063,553 | B1 * | 6/2006 | Mullen | F21V 19/006 | 439/336 |
| 7,153,167 | B1 * | 12/2006 | Switzer | H01R 33/22 | 439/642 |
| 7,311,425 | B2 * | 12/2007 | Jervey, III | F21S 8/06 | 362/391 |
| 8,814,459 | B1 * | 8/2014 | Berge | F16B 7/182 | 362/365 |
| 2008/0285291 | A1 * | 11/2008 | Fornari | F21S 8/02 | 362/396 |
| 2011/0140638 | A1 * | 6/2011 | Frazzini | F21V 21/22 | 315/313 |
| 2015/0364853 | A1 * | 12/2015 | Thijssen | F21V 23/06 | 439/660 |

* cited by examiner

*Primary Examiner* — Robert J May

(74) *Attorney, Agent, or Firm* — Lewis Kohn & Walker LLP; Kari Moyer-Henry

(57) ABSTRACT

A light socket adapter configured for use with specialty lighting, for example ornamental lighting features, which may not be compatible with a standard socket wherein the light socket adapter is capable of rotation at an angle, bending and flexing in any direction desired and being suitable for extension.

9 Claims, 14 Drawing Sheets

LIGHT SOCKET ADAPTER

RELATED APPLICATIONS

This application is a non-provisional application claiming the benefit of priority from U.S. Provisional Application No. 62/259,999 filed Nov. 25, 2015, the entire contents of which is herein incorporated.

FIELD OF INVENTION

The present invention pertains generally to light socket adapters. More particularly, the present invention pertains to a light socket adapter configured for use with specialty lighting, for example ornamental lighting features, which may not be compatible with a standard socket.

Light socket adapters are known in the art. The most well-known light socket adapters convert sockets to power plugs, decrease the socket size for a particular type of bulb, convert European to American sockets and/or convert a two-prong outlet to three-prong or vice versa.

Still there remains a need in the art for light socket adapters that are more versatile and therefore compatible with a larger variety of light fixtures.

In light of the above, it is an object of the present invention to provide the desired features described herein as well as additional advantages of being capable of rotation at an angle, bending and flexing in any direction desired and being suitable for extension.

SUMMARY OF THE INVENTION

An object of the present invention provides a light socket adapter.

It is another object of the present invention to provide a light socket adapter, the light socket adapter comprised of a first end corresponding to a standard light socket or LED Power Connector (and may correspond to any one of a plurality of available lighting connections or whatever is standard at the time) and a second end having a connector means wherein a main body is disposed there between for housing electrical wires.

It is still another object of the present invention to provide a light socket adapter wherein the connector means may be selected from the group consisting of magnetic, self-latching, ¼ turn lock mount, threaded mount, snap lock mount or any plurality of connection options available.

It is a further object of the present invention to provide a light socket adapter wherein the connector means is compatible with a plurality of ornamental lighting features.

It is another object of the present invention to provide a light socket adapter further comprising extension means.

It is yet another object of the present invention to provide a light socket adapter wherein the light socket adapter may be rotated 45 degrees from the main axis by engaging a hinge, the hinge positioned between the first end and the second end of the light socket adapter.

It is another object of the present invention to provide a miniature light socket adapter wherein the miniature light socket adapter may include all the features of the light socket adapter and is compatible with table lamps, ceiling lamps, and such.

It is another object of the present invention to provide a light socket adapter further comprised of a flexible metal or plastic tube wherein the main body of the light socket adapter is bendable in the desired direction.

It is still another object of the present invention to provide a light socket adapter further comprising of an adjustable bezel, the bezel being compatible with recessed lighting cans with various depths and diameters.

It is another object of the present invention to provide a light socket adapter further comprising a non-adjustable bezel, the bezel being compatible with specific sized recessed lighting cans.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar parts are identified with similar characters, and in which.

DETAILED DESCRIPTION OF THE INVENTION

Figure 1:
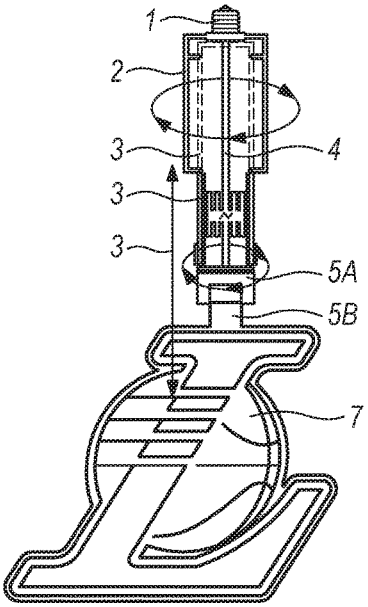
FIG. 1 illustrates the first embodiment of the light socket adapter of the present invention.

The light socket adapter of the present invention is shown in FIG. 1. The light socket adapter is comprised of a first end having a standard light socket screw 1 and a second end having a magnetic connector 5A wherein the magnetic connector 5A is a female connector. The magnetic connector 5A feeds electricity to the ornament 7. Ornament 7 attaches to magnetic connector 5A by way of ornament connector 5B. The light socket adapter is further comprised of a rotating piece 2 attached to the standard light socket screw 1 wherein the rotating piece 2 rotates with the light socket adapter screw 1 while simultaneously rotating around the main body 3 of the adapter. Main body 3 houses the electrical wiring 4 and may have additional power outlets. Alternatively, the first end of the light socket adapter may correspond to any one of a plurality of bases available for use in light sockets.

Figure 2:
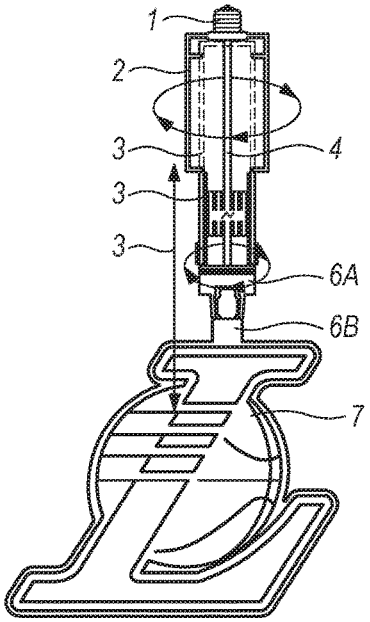
FIG. 2 illustrates the second embodiment of the light socket adapter of the present invention.

Regarding FIG. 2, shown is a second embodiment of the connector of the present invention. In this embodiment, the main body 3 is equipped with a self-latching connector 6A wherein the self-latching connector 6A is a female connector. The self-latching connector 6A feeds electricity to the ornament 7. Ornament 7 attaches to self-latching connector 6A by way of ornament connector 6B.

Figure 3:
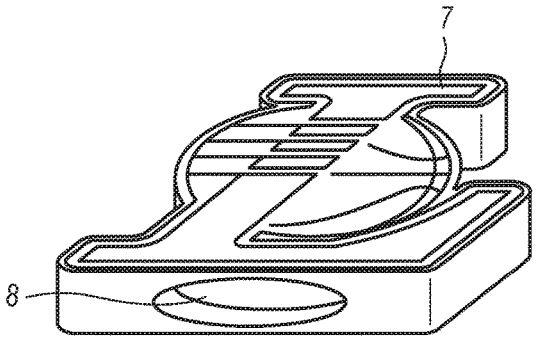
FIG. 3 illustrates an exemplary ornamental light for use with the present invention.

Regarding FIG. 3, shown is an exemplary ornament 7 for use in conjunction with the light socket adapter of the present invention. The bottom end of the ornament 7 may have an additional component 8 allowing for supplemental lighting sources. The ornament 7 is ideally lightweight and translucent to allow the ornament 7 to light up. Alternatively, the ornament may be any size or shape imaginable with an infinite variety of features.

Figure 4:
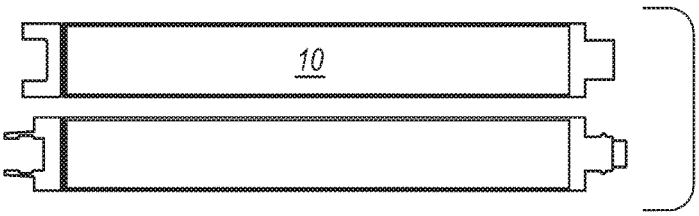
FIG. 4 illustrates the third embodiment of the light socket adapter of the present invention.

Regarding FIG. 4, shown is an optional extension 10 for the light socket adapter of the present invention. The extension 10 allows for use of the adapter with higher ceilings such that the ornament may be lowered into the desired position for creating the desired lighting effect. Multiple extensions 10 may be used simultaneously depending on the height of the ceiling and/or distance of the socket from the area to be lit.

Figure 5:
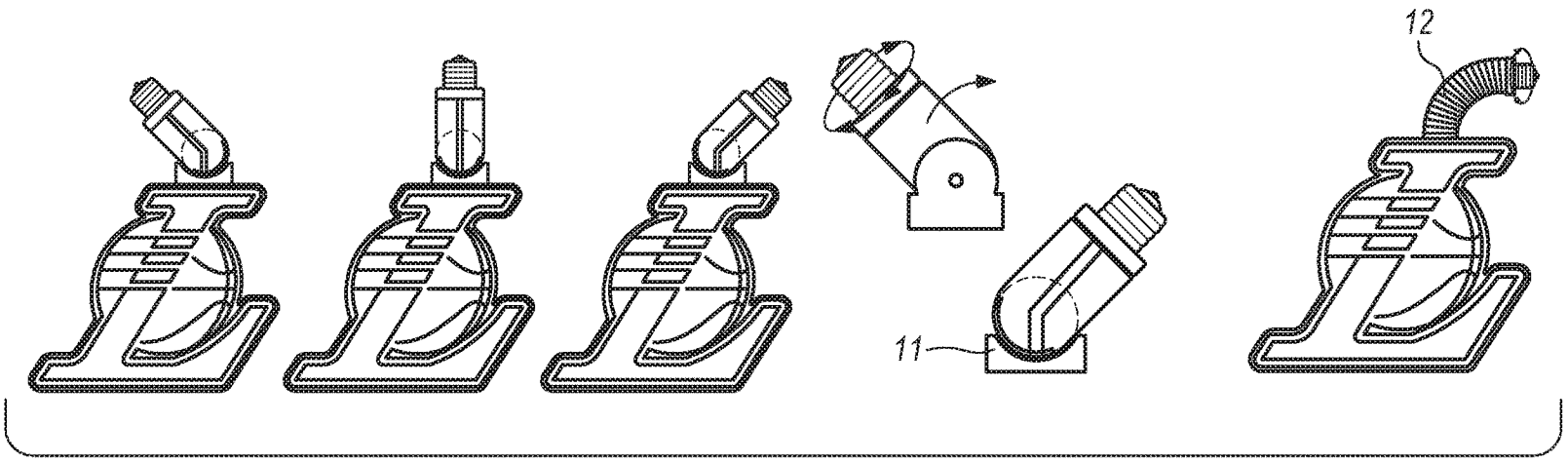
FIG. 5 illustrates the fourth embodiment of the light socket adapter of the present invention.

Regarding FIG. 5, shown is a miniature embodiment of the light socket adapter of the present invention. The miniature adapter 11 is compatible with table lamps, ceiling lamps, and such. The miniature adapter 11 may be either magnetic, self-latching, ¼ turn lock mount, threaded mount, snap lock mount or any plurality of connection options available with lighting fixtures. The miniature adapter 11 is further capable of rotating 45 degrees in either direction from the main axis and may connect from either above or below an ornament. A further still embodiment of the miniature adapter 11 may be comprised of a flexible metal or plastic tube 12 which is bendable to accommodate sockets in various inconvenient locations.

Figure 6:
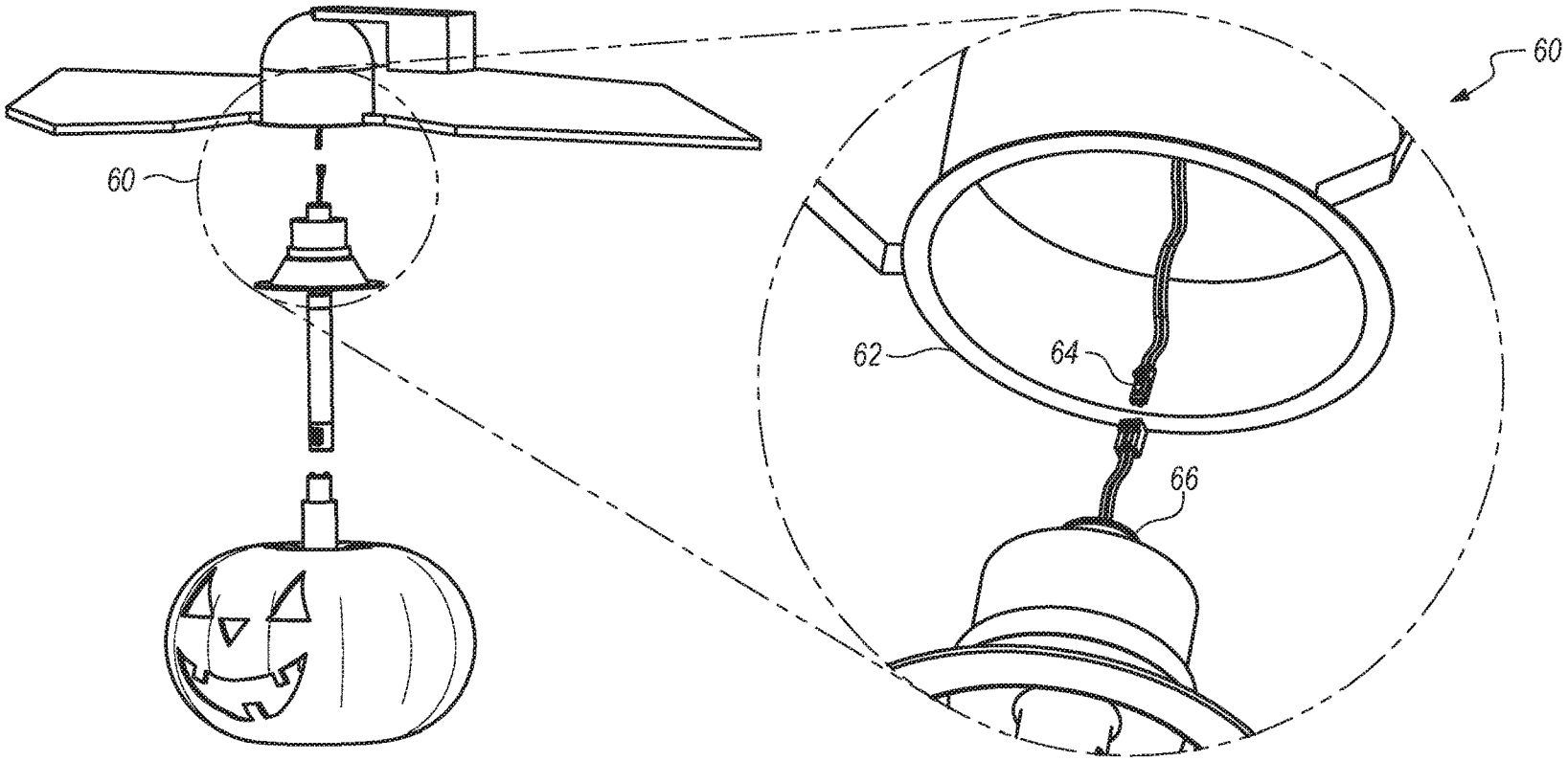
FIG. 6 illustrates a further embodiment of the light socket adapter of the present invention.

Regarding FIG. 6, shown is an alternative embodiment of the light socket adapter of the present invention. Adapter 60 is for use of the device with a more modern recessed lighting can that is wired solely for use with LED recessed lighting fixtures. Adapter 60 is further comprised of an LED adapter 66 for connection to the power connector 64 of a LED recessed light fixture 62.

Figure 7A:
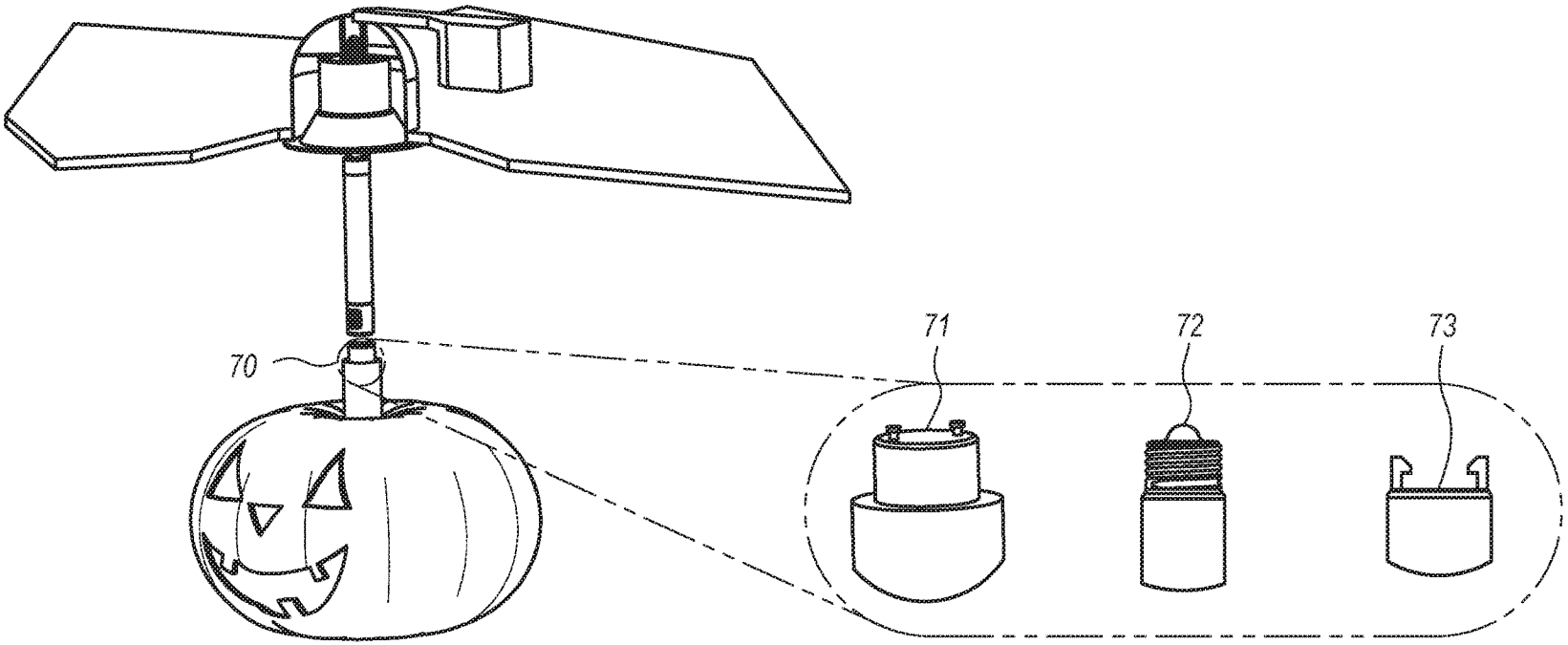
FIGS. 7*a* and 7*b* illustrate examples of the many various types of connector means for use with the present invention.
Figure 7B:
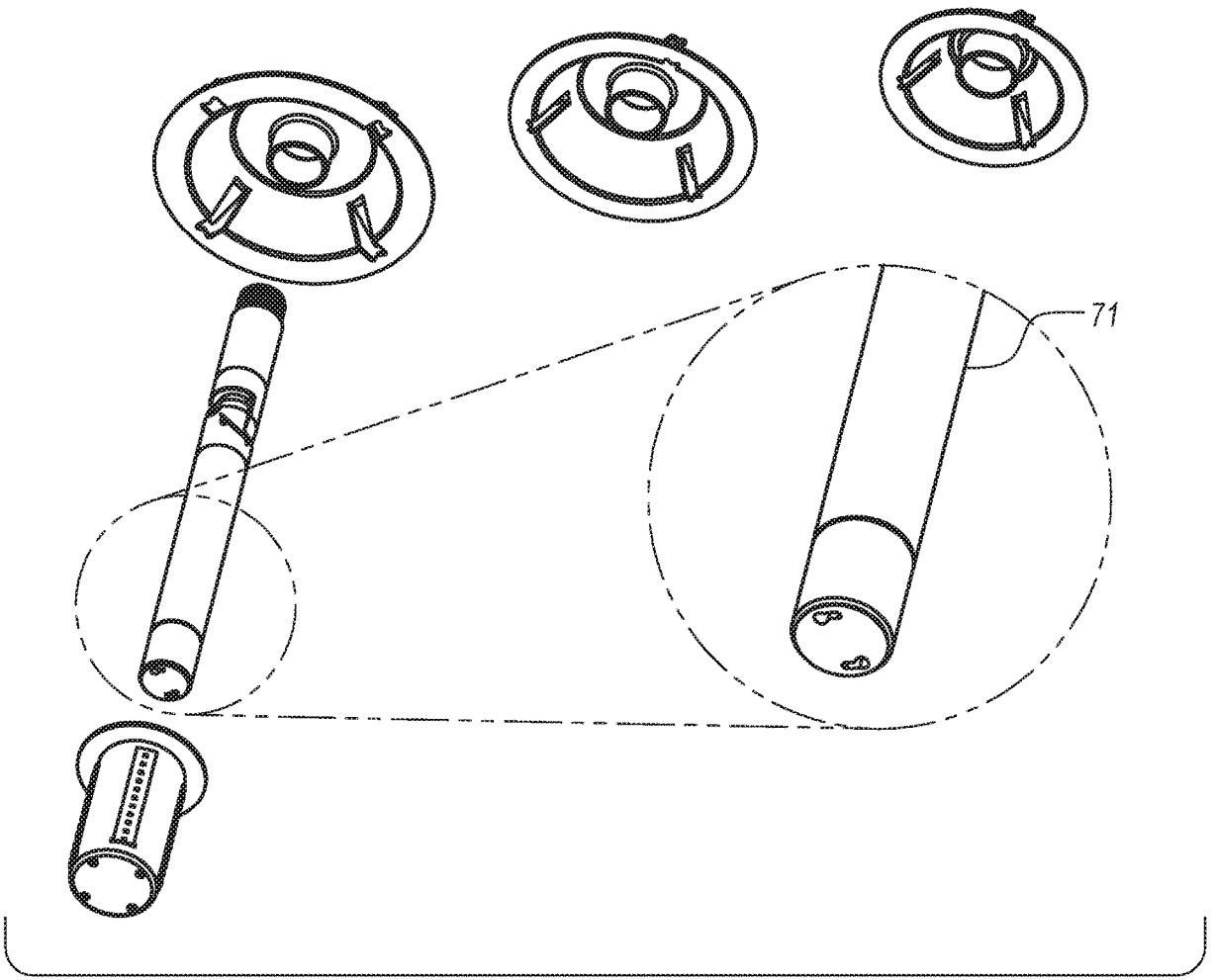
Figure 8:
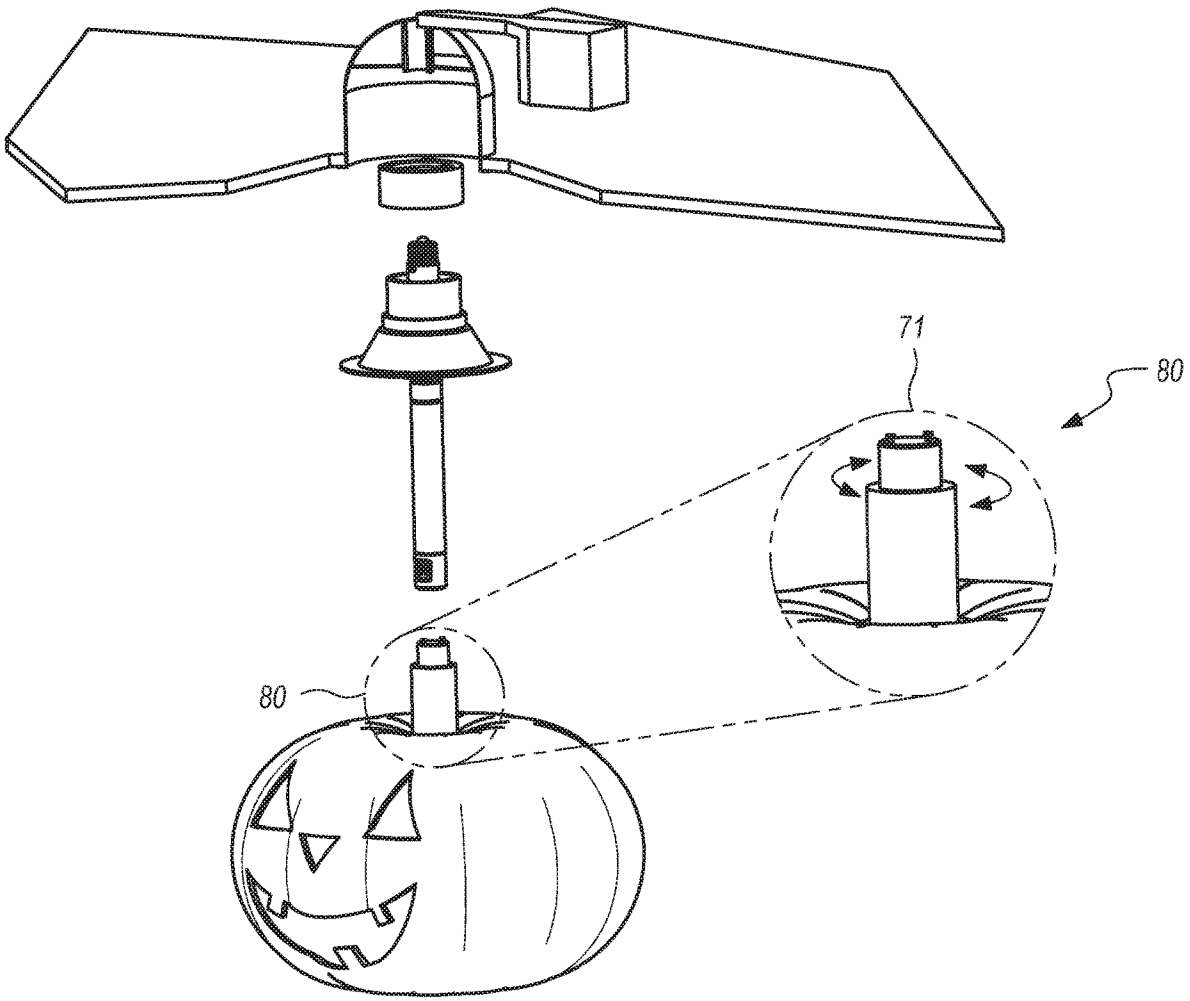
FIG. 8 illustrates an exemplary ornamental object with a swivel for use with the present invention.

Regarding FIG. 7*a*, shown are three optional embodiments of the connector 70 of the second end of the present invention. One embodiment provides a ¼ turn lock mount 71. Another embodiment provides a threaded mount 72. Still another embodiment provides a snap lock mount 73. FIG. 7*b* shows a close up of the female connector of a ¼ turn lock mount 71. Further with regard to FIG. 8, shown is a swivel attachment 80 for the ornaments allowing for proper positioning of ornaments following installation.

Figure 9A:
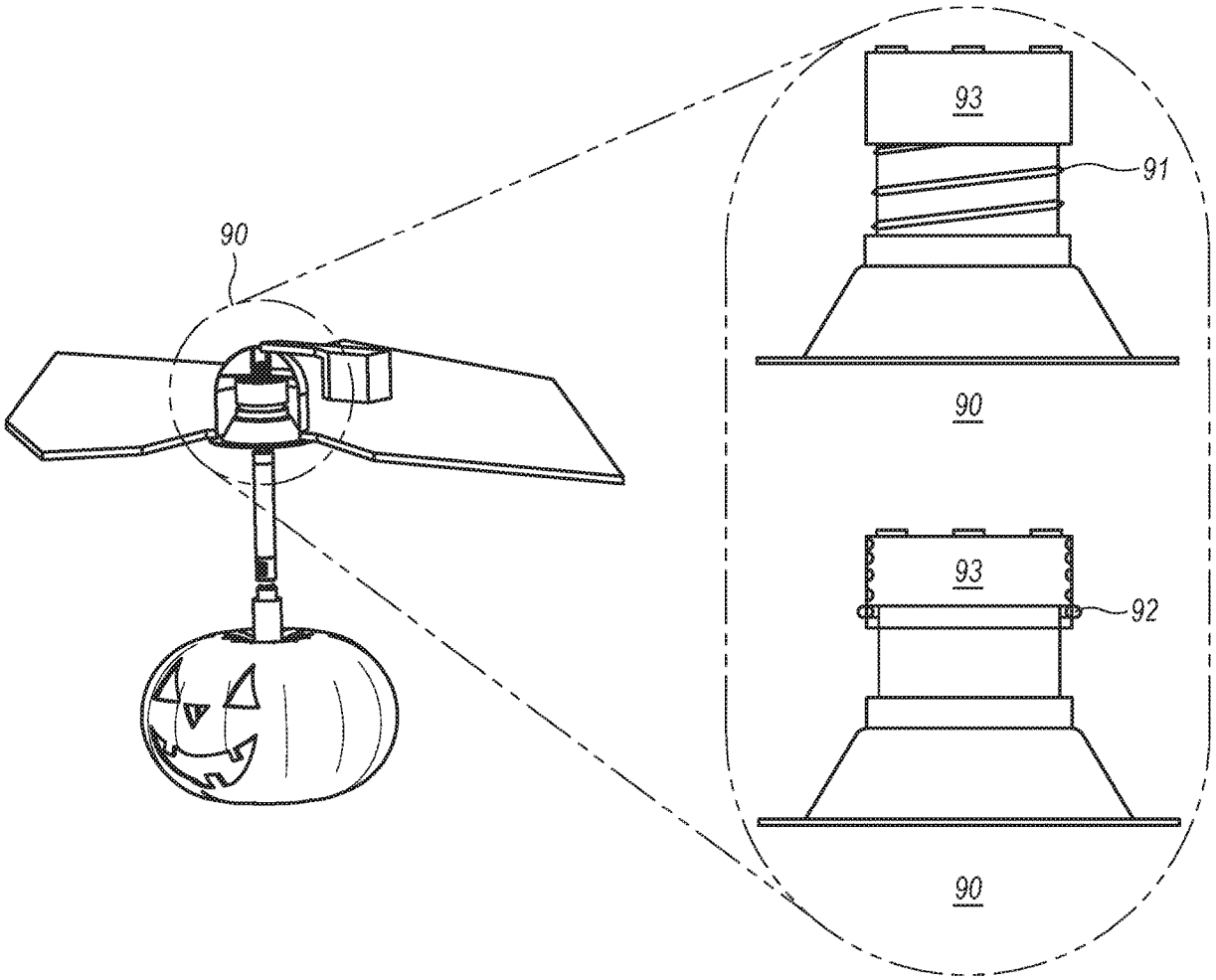
FIG. 9*a*-9*d* illustrate both a non-adjustable bezel and an adjustable bezel, for use with the present invention.
Figure 9B:
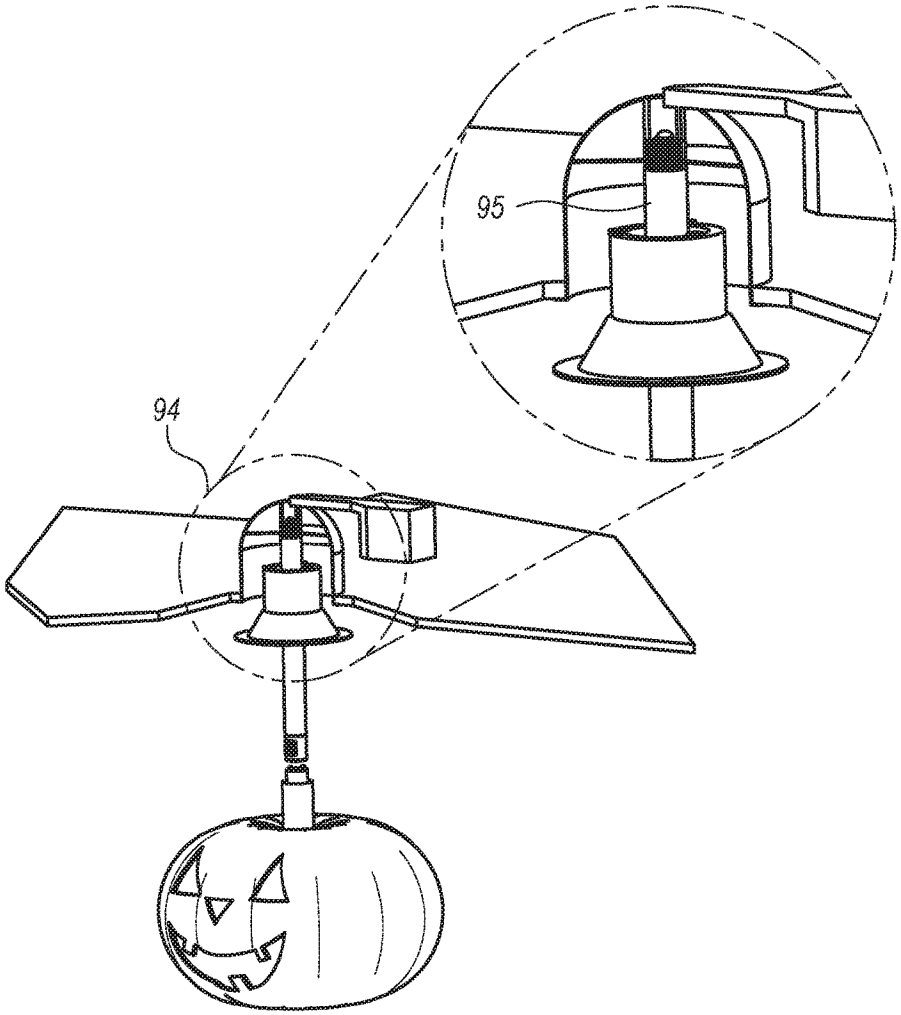
Figure 9C:
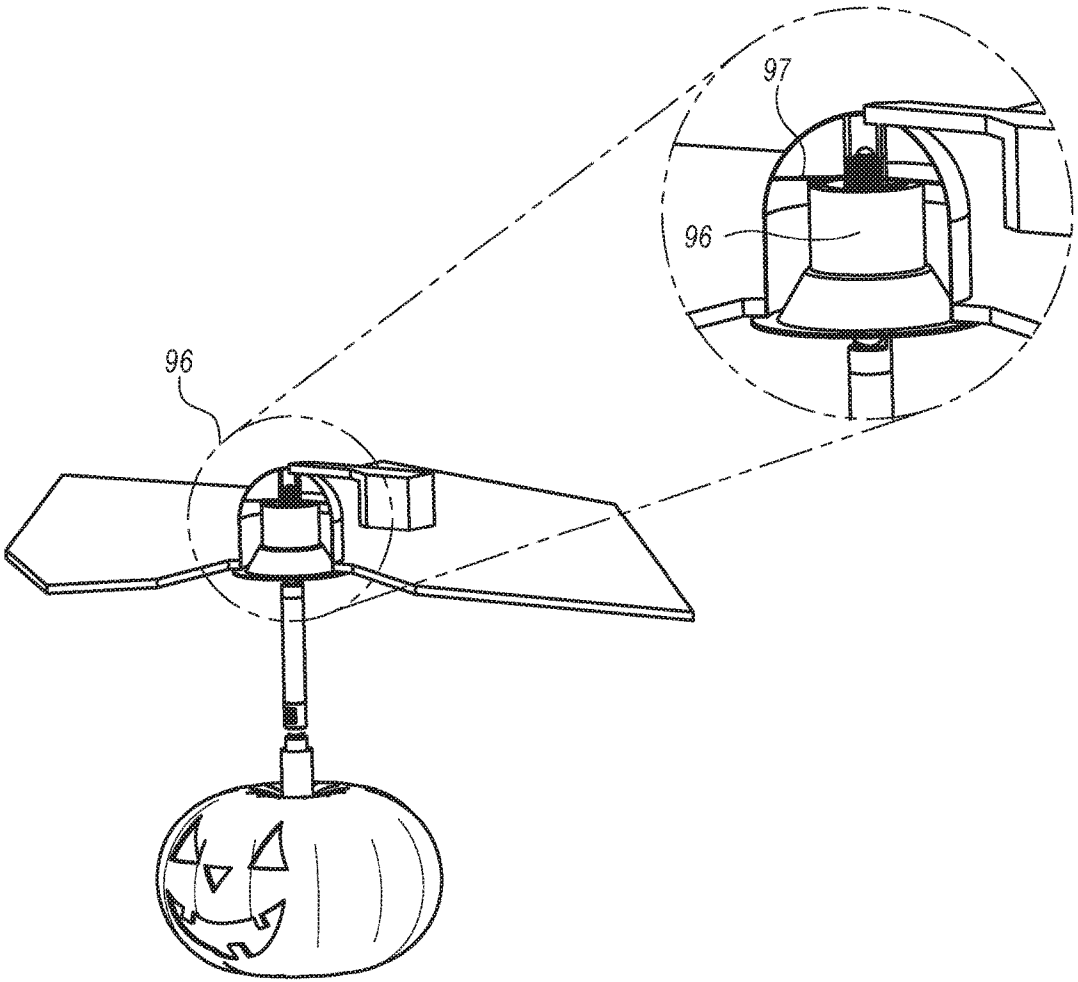
Figure 9D:
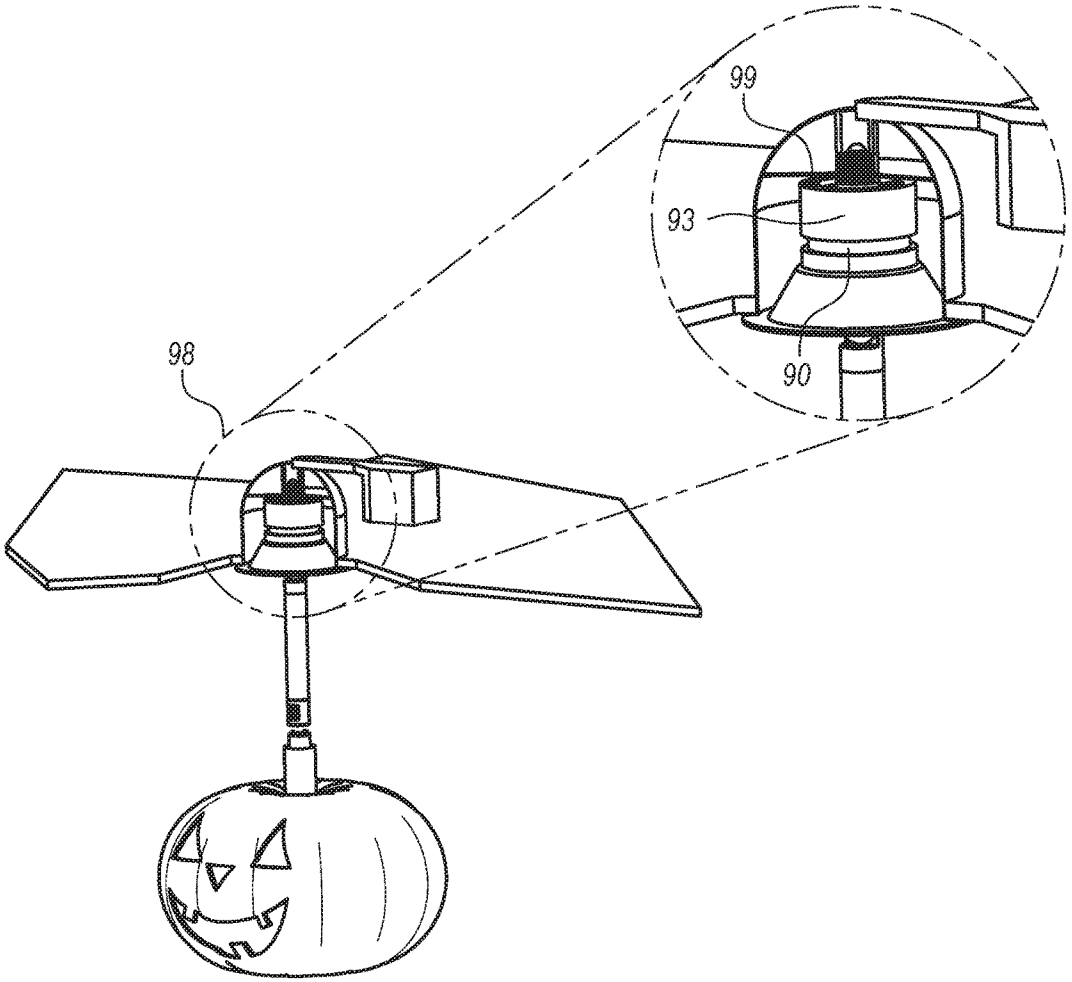

Regarding FIGS. 9*a* and 9*d*, shown is an adjustable bezel 90 of the light socket adapter of the present invention. The bezel 90 can adjust in height via threads 91 or pin locks 92, the bezel being compatible with recessed lighting cans with various depths and diameters. Bezel collar 93 adjusts the height of bezel 90 by moving up and down to extend or shorten the length of the bezel. FIG. 9*d* shows the adjustable bezel 98 in a recessed lighting can. FIG. 9*b* shows a bezel 94 that does not adjust and is designed to fit a specific can size. Bezel 94 may move vertically up and down the length of the main body 95. FIG. 9*c* shows the non-adjustable bezel 96 in a recessed lighting can wherein the bezel 96 is pushed up and magnetically connected to the can wherein the magnets are neodymium magnets 97. In this example, the top of bezel 96 does not pass below the hinge on the main body (see FIG. 10*a*-10*c*). FIG. 9*d* shows an adjustable bezel 98 having a moving collar 93 which moves up and down to extend or shorten the length of the bezel. FIG. 9*a*-9*d* show the position of neodymium magnets 97 on the bezel that help secure the bezel to the can housing 99 and ceiling bracket.

Figure 10B:
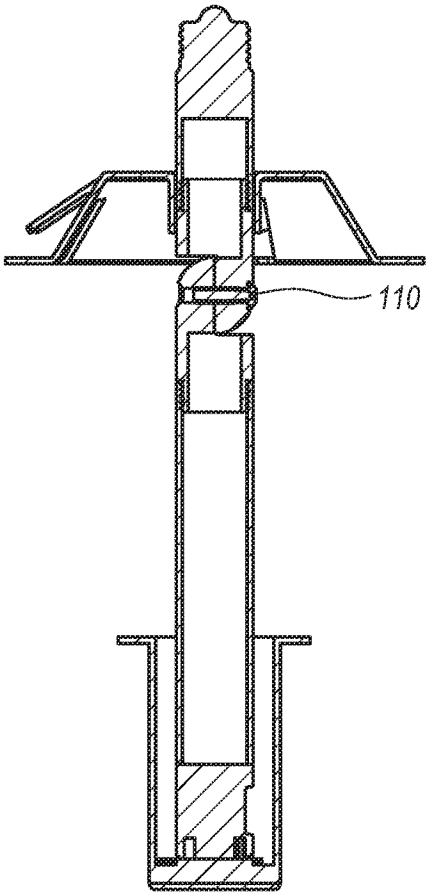
FIG. 10*a*-10*c* illustrate a hinge of the light socket adapter of the present invention.
Figure 10A:
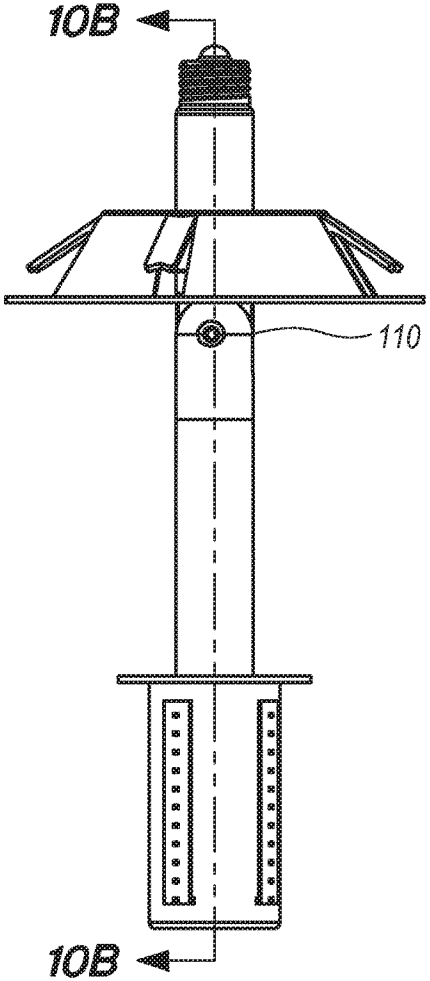
Figure 10C:
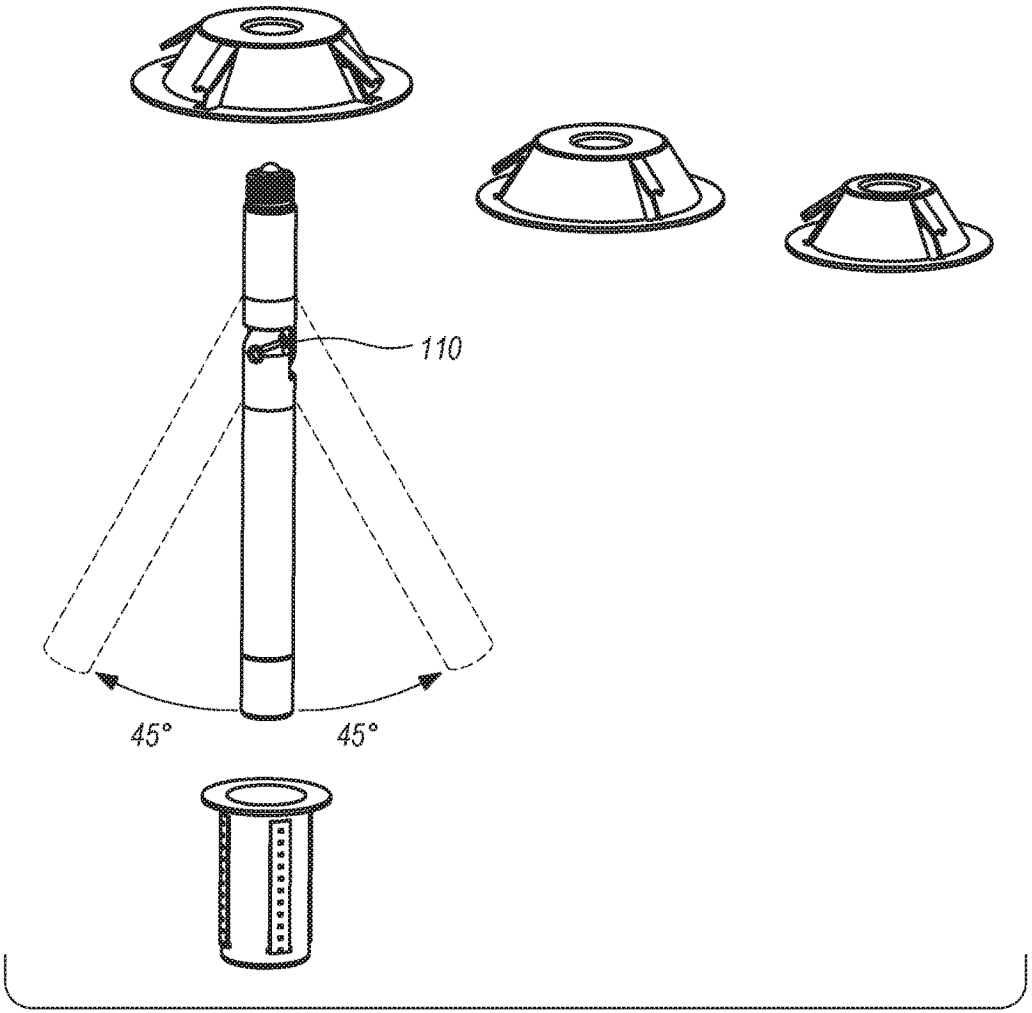

Regarding FIG. 10*a*-10*c*, shown is the light socket adapter of the present invention further comprising a hinge. FIG. 10*b*, a cross-section of FIG. 10*a*, illustrates the relative position of hinge 110 while FIG. 10*c* illustrates the optional rotation of the second end of the light socket adapter in relation to the static first end of the light socket adapter. Hinge 110 may rotate 45° from the main axis to accommodate lighting fixtures positions on vaulted ceilings.

Figure 11A:
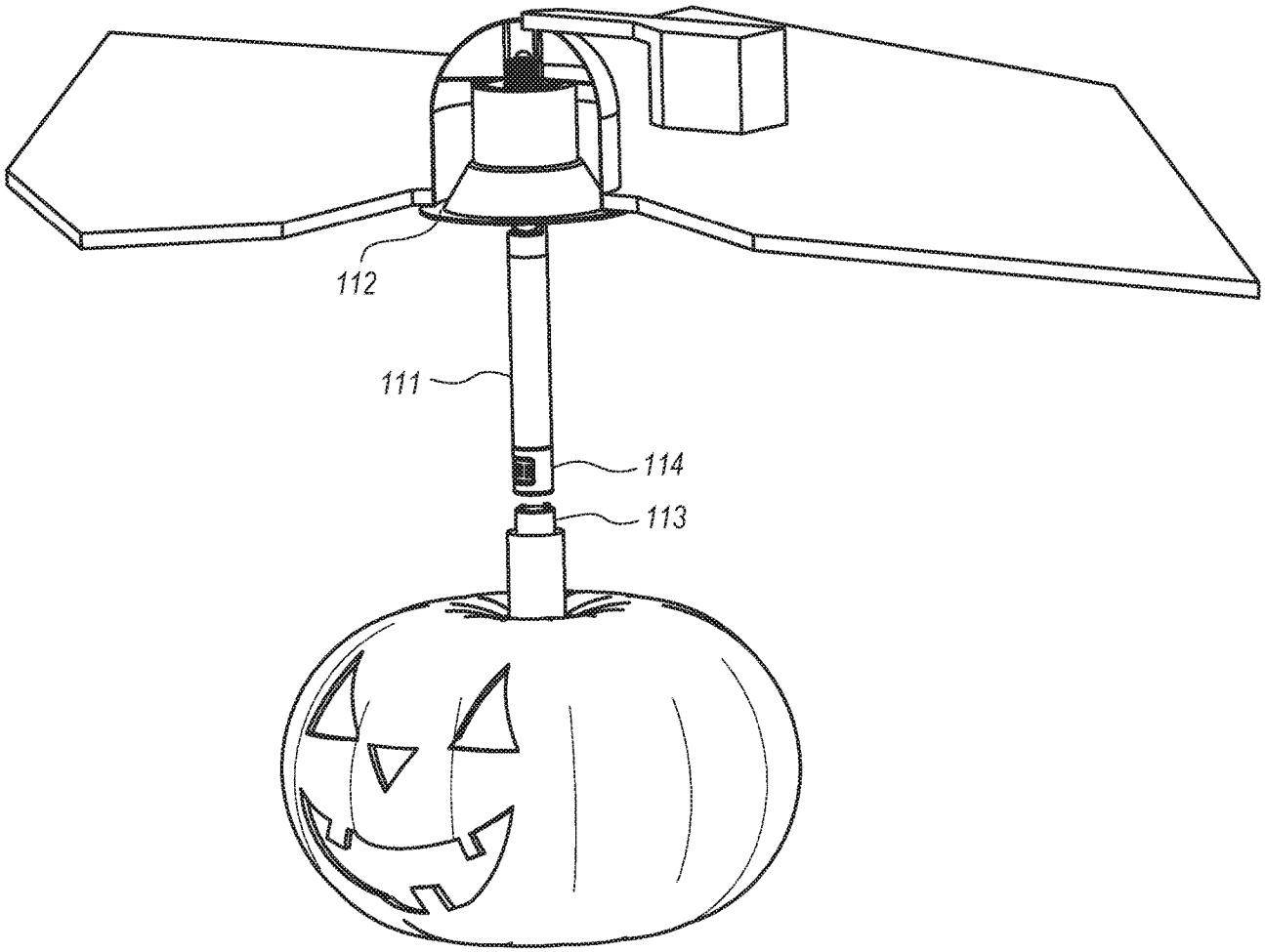
FIG. 11*a* and 11*b* illustrate a fifth embodiment of the light socket adapter of the present invention.
Figure 11B:
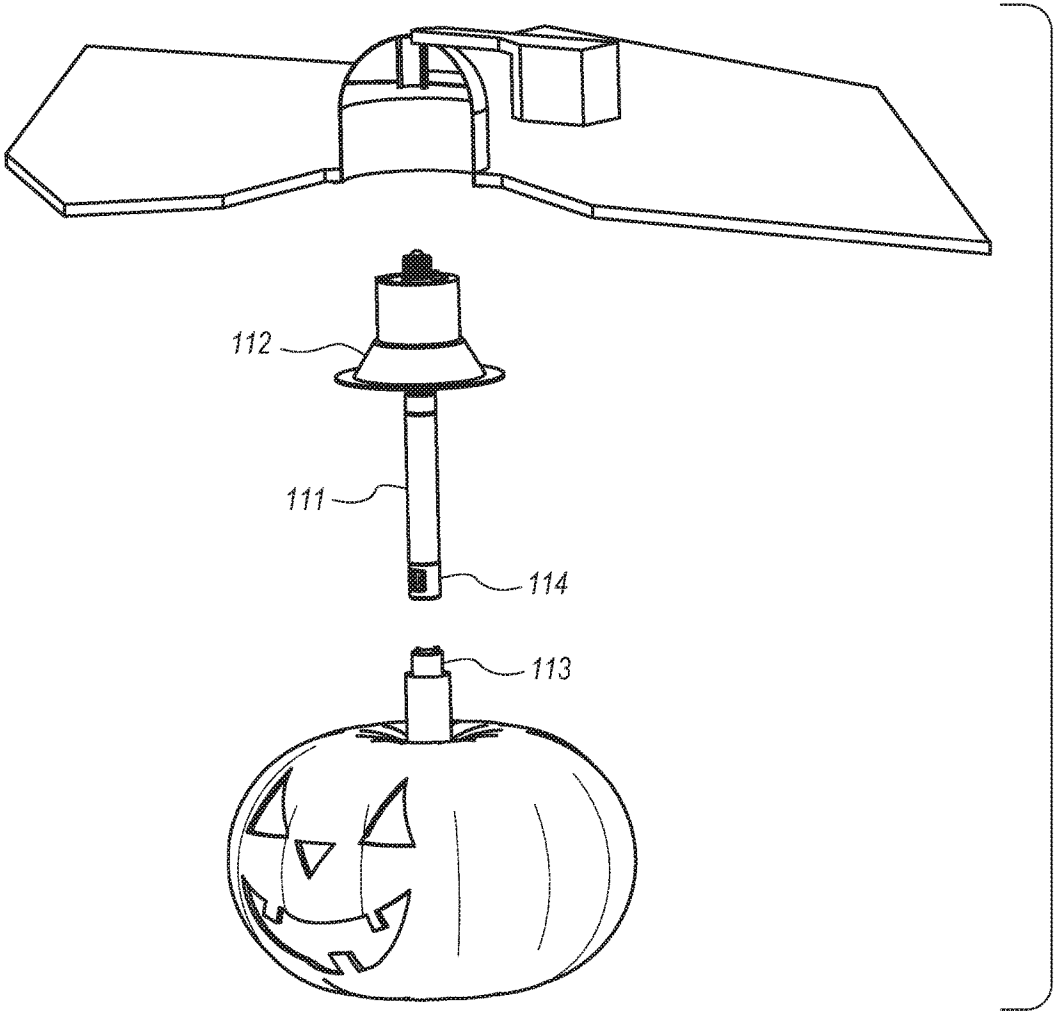

Regarding FIGS. 11*a* and 11*b*, shown is a complete embodiment of the present invention. FIG. 11*a* illustrate the light socket adapter having a main body 111, an adjustable bezel 112, a ¼ turn lock mount 113, and optional additional power outlets 114. FIG. 11*b* illustrates the complete embodiment in an exploded view.

In the first embodiment, the present invention provides a light socket adapter.

In another embodiment, the present invention provides a light socket adapter, the light socket adapter comprised of a first end corresponding to a standard light socket or LED Power Connector (and may correspond to any one of a plurality of available lighting connections or whatever is standard at the time) and a second end having a connector means wherein a main body is disposed there between for housing electrical wires.

In still another embodiment, the present invention provides a light socket adapter wherein the connector means may be selected from the group consisting of magnetic, self-latching, ¼ turn lock mount, threaded mount, snap lock mount or any plurality of connection options available.

In another embodiment, the present invention provides a light socket adapter wherein the connector means is compatible with a plurality of ornamental lighting features.

In yet another embodiment, the present invention provides a light socket adapter further comprising extensions means.

In a further embodiment, the present invention provides a light socket adapter wherein the light socket adapter may be rotated 45 degrees from the main axis by engaging a hinge wherein the hinge is positioned between the first end and the second end of the light socket adapter.

In a further embodiment, the present invention provides a miniature light socket adapter wherein the miniature light socket adapter may include all the features of the light socket adapter and is compatible with table lamps, ceiling lamps, and such.

In a further still embodiment, the present invention provides a light socket adapter further comprised of a flexible metal or plastic tube wherein the main body of the light socket adapter is bendable in the desired direction.

In a further still embodiment, the present invention provides a light socket adapter further comprised of a hinge component for use with ceilings that are not parallel to the ground or of a vaulted nature. Thus, allowing the socket adapter and subsequent lighting fixture to hang in a vertical fashion.

In yet a further embodiment, the present invention provides a light socket adapter further comprised of a bezel positioned at the first end of the adapter. In a preferred embodiment, the bezel is adjustable via threads or pin locks. In another preferred embodiment, the bezel is non-adjustable.

The foregoing detailed description is not to be taken in a limiting sense, and the scope of the present invention is defined by the appended claims and their equivalents. Although several embodiments have been presented, one skilled in the art will appreciate that various modifications are possible. Such variations will not materially alter the nature of the invention. Many embodiments may be conceived and may not achieve all the advantages of some embodiments, particularly preferred embodiments, yet the absence of a particular advantage shall not be construed to necessarily mean that such an embodiment is outside the scope of the present invention.

We claim:

1. A light socket adapter wherein the light socket adapter is comprised of:

a first end wherein the first end is further comprised of a first connector mount for connection to a lighting fixture and wherein the first end is further comprised of an adjustable bezel, the bezel being compatible with recessed lighting cans having various depths and diameters; and a second end wherein the second end is further comprised of a second connector mount, wherein the adapter is further comprised of a main body disposed between the first end and the second end, the main body housing electrical wires wherein the main body is further comprised of at least one electrical outlet and wherein at least a portion of the main body is comprised of a bendable tube.

2. The light socket adapter of claim 1, wherein the first connector mount may correspond to any one of a plurality of available lighting connections.

3. The light socket adapter of claim 1, wherein the second connector mount is selected from the group consisting of magnetic mount, self-latching mount, ¼ turn lock mount, threaded mount, and snap lock mount.

4. The light socket of adapter of claim 3, wherein the second connector mount is compatible with an ornamental lighting feature.

5. The light socket adapter of claim 1, wherein the adapter is further comprised of an extension means.

6. The light socket adapter of claim 1, wherein the adapter is further comprised of a hinge, the hinge being positioned between the first end and the second end.

7. The light socket adapter of claim 6, wherein the hinge rotates 45° thereby rotating the light socket adapter.

8. The light socket adapter of claim 1, wherein the bendable tube is further comprised of a flexible metal or plastic tube.

9. The light socket adapter of claim 1, wherein the lighting fixture is a LED recessed lighting fixture.

* * * * *